US007866913B2

(12) United States Patent
Kulp et al.

(10) Patent No.: US 7,866,913 B2
(45) **Date of Patent: *Jan. 11, 2011**

(54) WATER-BALLASTED PROTECTION BARRIER

(75) Inventors: Jack H. Kulp, Dana Point, CA (US); Felipe Almanza, Perris, CA (US)

(73) Assignee: Traffix Devices Inc., San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/569,170

(22) Filed: Sep. 29, 2009

(65) Prior Publication Data

US 2010/0014914 A1 Jan. 21, 2010

Related U.S. Application Data

(62) Division of application No. 11/233,387, filed on Sep. 21, 2005.

(60) Provisional application No. 60/612,004, filed on Sep. 21, 2004.

(51) Int. Cl.
*E01F 13/00* (2006.01)

(52) U.S. Cl. ..... 404/6; 404/9; 256/13.1

(58) Field of Classification Search ..... 404/6, 404/9; 256/13.1
See application file for complete search history.

(56) References Cited

U.S. PATENT DOCUMENTS

| | | | | |
|---|---|---|---|---|
| 4,376,594 | A * | 3/1983 | Prosenz | 404/6 |
| 4,500,225 | A | 2/1985 | Quittner | |
| 4,681,302 | A * | 7/1987 | Thompson | 256/13.1 |
| 4,844,652 | A * | 7/1989 | Schroughan | 404/6 |
| 4,869,617 | A | 9/1989 | Chiodo | |
| 5,080,523 | A * | 1/1992 | Steiner | 404/7 |
| 5,425,594 | A | 6/1995 | Krage et al. | |
| 5,498,101 | A | 3/1996 | Braverman | |
| 5,605,413 | A | 2/1997 | Brown | |
| D400,264 | S | 10/1998 | Striefel et al. | |
| 5,882,140 | A | 3/1999 | Yodock, Jr. et al. | |
| 5,988,934 | A | 11/1999 | Wasserstrom | |
| 6,059,491 | A | 5/2000 | Striefel et al. | |
| 6,086,285 | A * | 7/2000 | Christensen | 404/6 |
| D431,657 | S | 10/2000 | Wasserstrom | |
| 6,203,242 | B1 | 3/2001 | Englund | |
| 6,413,009 | B1 | 7/2002 | Duckett | |
| D462,126 | S | 8/2002 | Englund | |
| 6,666,616 | B2 | 12/2003 | Yodock, III et al. | |
| 6,669,402 | B1 | 12/2003 | Davis et al. | |
| 6,863,468 | B2 | 3/2005 | Davis et al. | |
| 2003/0219308 | A1 * | 11/2003 | Boulais et al. | 404/6 |
| 2004/0057792 | A1 | 3/2004 | Yodock, III et al. | |
| 2004/0096273 | A1 | 5/2004 | Yodock, III et al. | |
| 2008/0118305 | A1 * | 5/2008 | Carey | 404/6 |

* cited by examiner

*Primary Examiner*—Raymond W Addie
(74) *Attorney, Agent, or Firm*—Stout, Uxa, Buyan & Mullins, LLP; Donald E. Stout

(57) ABSTRACT

A water-ballasted barrier system incorporates a concave reflective design, wherein outer walls of the barrier segment are configured in a concave manner. The concave section is designed to prevent the tire of a vehicle, impacting the barrier, from climbing up the side of the barrier segment, by pocketing the tire in the curved center portion of the barrier wall. Adjacent barrier segments are attached together using an interlocking knuckle design, having a lug pin connection system. In some embodiments, wire rope cable is internally molded into each barrier segment to strengthen the barrier system.

11 Claims, 6 Drawing Sheets

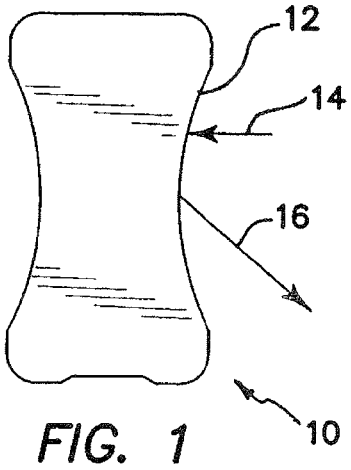
FIG. 1
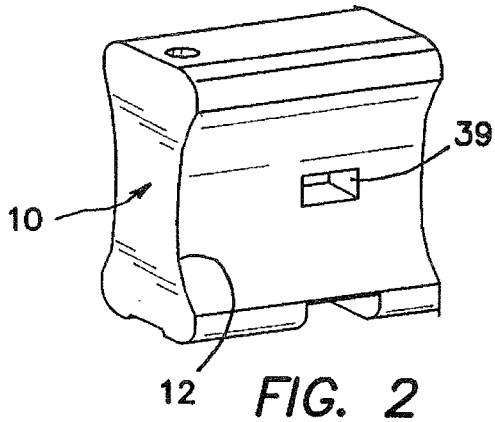
FIG. 2
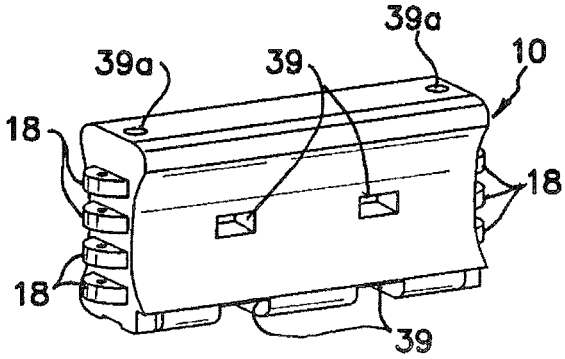
FIG. 3
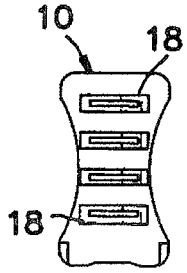
FIG. 5
FIG. 4
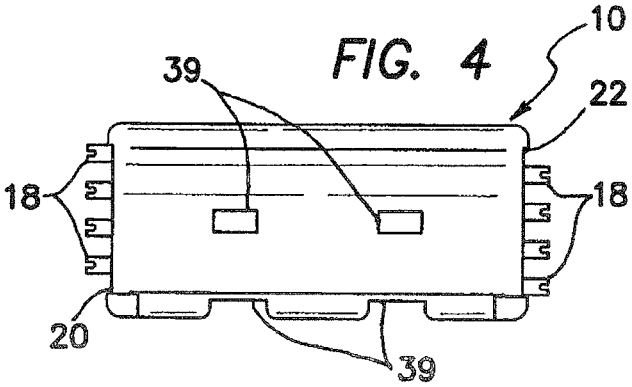
FIG. 6
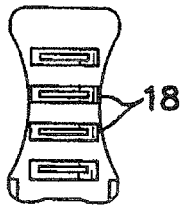

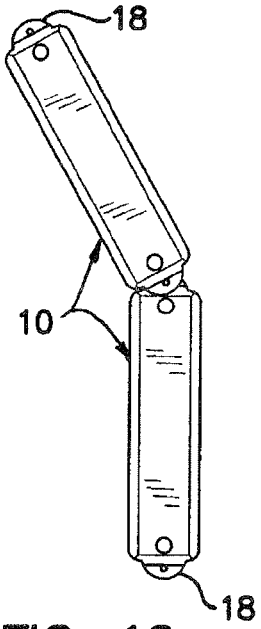
FIG. 12
FIG. 13
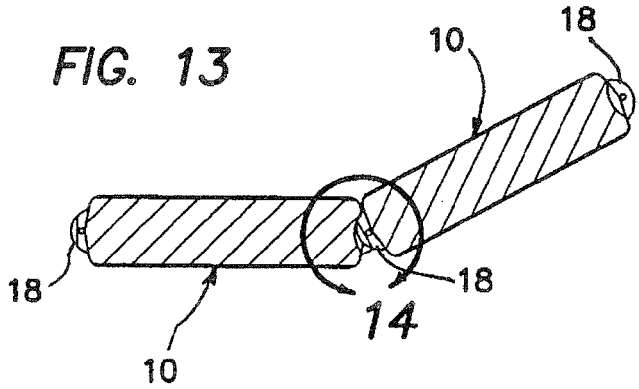
FIG. 14
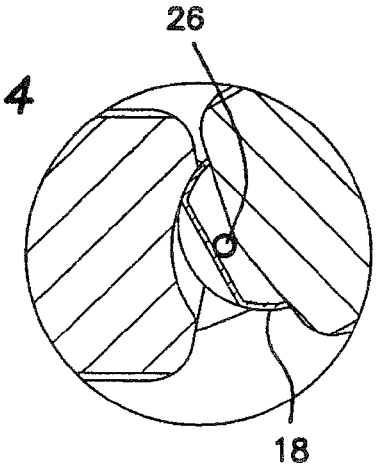
FIG. 15
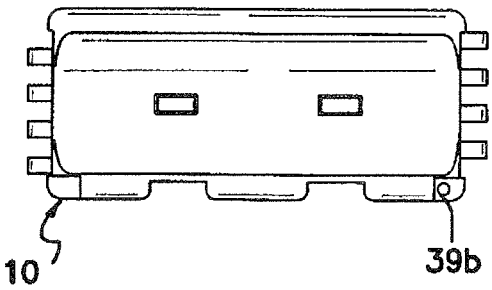
FIG. 16
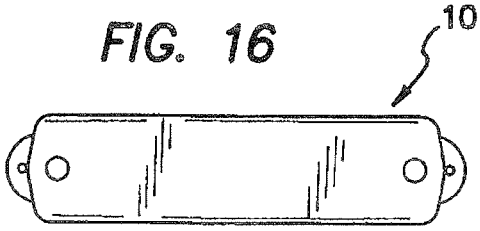
FIG. 17
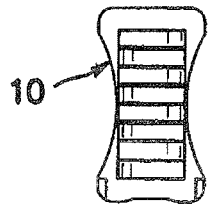

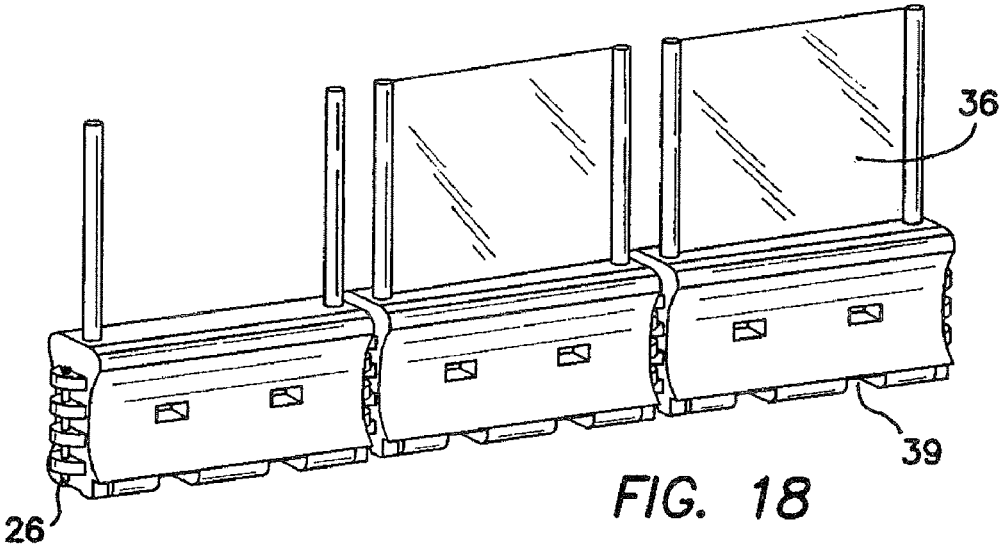
FIG. 18
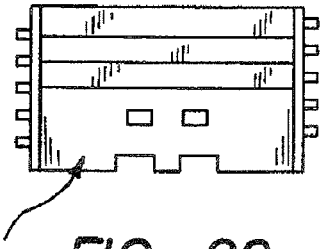
FIG. 20
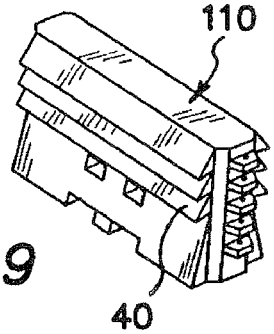
FIG. 19
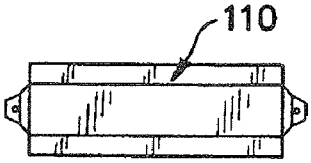
FIG. 22
FIG. 21
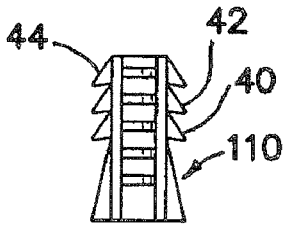

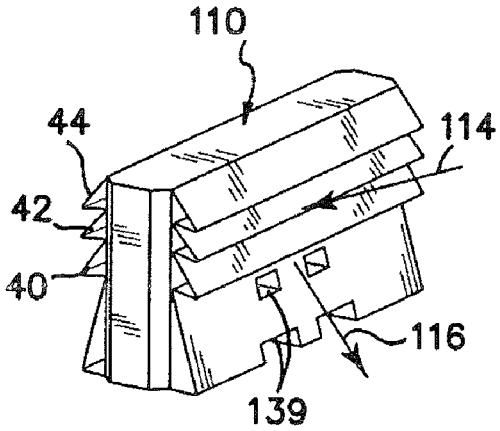
FIG. 23
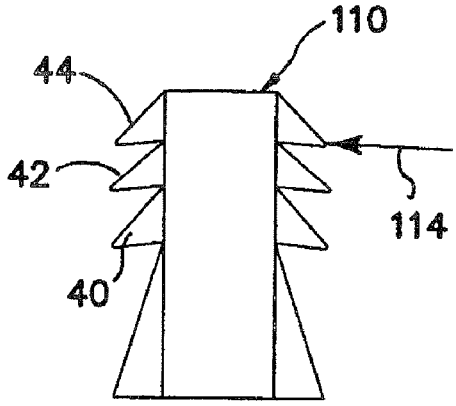
FIG. 24
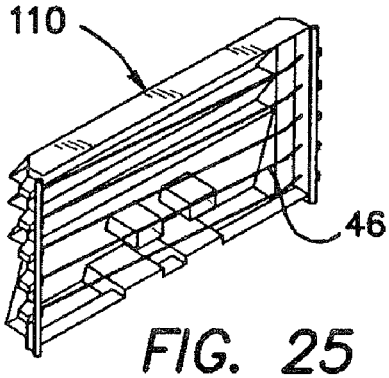
FIG. 25
FIG. 27
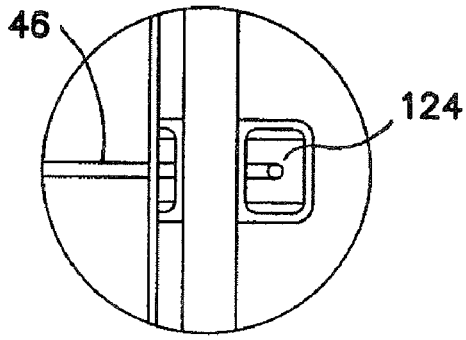
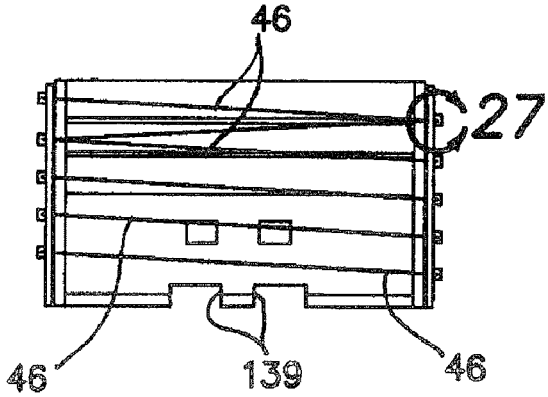
FIG. 26

WATER-BALLASTED PROTECTION BARRIER

This application is a divisional application under 35 U.S.C. 120 of commonly assigned U.S. patent application Ser. No. 11/233,387 entitled Water-Ballasted Protection Barrier, filed Sep. 21, 2005, presently pending, which in turn claims the benefit under 35 U.S.C. 119(e) of the filing date of Provisional U.S. Application Ser. No. 60/612,004, entitled Water Wall, and filed on Sep. 21, 2004. Each of the above referenced applications are expressly incorporated herein by reference, in their entirety.

BACKGROUND OF THE INVENTION

The present invention relates generally to vehicle protection barriers, and more particularly to movable water ballasted vehicle traffic protection barriers for applications such as pedestrian protection, traffic work zone separation, airport runway divisions, and industrial commercial uses.

Water ballasted vehicle traffic protection barriers of the type described herein are known in the prior art. Generally, such barriers are comprised of molded, lightweight plastic, and are hollow, having a fill port for filling them with water to ballast them in place. The barriers are fabricated to be sectional and modular, so that, once placed in a desired location, they can be attached together lengthwise to create a barrier of any desired length.

Prior art water ballasted barriers of this type have a certain utility, but have been plagued with durability problems, and have difficulty meeting current federal highway safety standards, specifically the Federal Highway Administration Standards of Report NCHRP 350. Failure of a barrier to meet these standards excludes the barrier from use on any highway project which is funded in whole or in part by federal highway funds, and thus severely limits that barrier's usefulness. Typically, failures occur because the barrier cannot pass vehicle impact tests required under NCHRP 350 standards. Test level 1 (TL-1) standards requires an 820 kg vehicle to impact the water wall barrier at 50 kilometers per hour (kph) at an impact angle of 20 degrees, and a 2000 kg vehicle to impact the water wall barrier at 50 kph at an impact angle of 25 degrees. Test level 2 (TL-2) standards require an impact velocity of 70 kph, with the same vehicle weights and impact angles as for TL-1 tests. Test level 3 (TL-3) standards require an impact velocity of 100 kph, again with the same vehicle weights and impact angles as for TL-1 and TL-2 tests. To pass these impact tests, the barrier must keep the impact vehicle from penetrating and driving over the water wall, as well as keeping the impact vehicle from rolling over on its side or roof. Additionally, occupant velocity must not exceed 12 m/s, and the ride-down acceleration must not exceed 20 g.

What is needed, therefore, is an improved water ballasted protection barrier system which can successfully meet the TL-1, TL-2, and TL-3 test standards described above.

SUMMARY OF THE INVENTION

Accordingly, there are disclosed herein two embodiments of a water ballasted protection barrier system which are together capable of meeting all three test standards discussed above.

More particularly, there is provided a barrier segment which is hollow and adapted to be filled with a fluent material for ballast. The barrier segment comprises a molded plastic container having outer walls defining an interior volume and having a first end and a second end. A plurality of connecting lugs are disposed on each of the first and second ends, so that a plurality of barrier segments may be joined together. A length of metallic cable, preferably stainless steel wire rope cable, is molded within the molded plastic container, so that most of the length of metallic cable is entirely disposed within the interior volume of the container, along substantially an entire length of the container between the first and second ends thereof.

A hole is molded into in each of the connecting lugs, for receiving a connecting pin. In some applications, the inventive barrier includes a fence post adapted for disposition over a top end of a connecting pin, for supporting a fence above the barrier segment.

In another aspect of the invention, there is provided a barrier segment which is hollow and adapted to be filled with a fluent material for ballast. The barrier segment comprises a molded plastic container having outer walls defining an interior volume and having a first end and a second end. The outer walls have a plurality of sawtooth segments disposed thereon, which are arranged vertically and extend outwardly and downwardly in order to deflect vehicles impacting the barrier segment in a downward direction. Preferably, there are three sawtooth segments disposed on each lengthwise outer wall.

A length of metallic cable is preferably molded within the molded plastic container, so that most of the length of metallic cable is entirely disposed within the interior volume, along substantially an entire length of the container between the first and second ends.

In still another aspect of the invention, there is provided a barrier segment which is hollow and adapted to be filled with a fluent material for ballast. The barrier segment comprises a molded plastic container having outer walls defining an interior volume and having a first end and a second end. A plurality of connecting lugs are disposed on each of the first and second ends, so that a plurality of barrier segments may be joined together. Each of the connecting lugs comprises a hole for receiving a connecting pin therethrough, and a double-walled reinforcing portion adjacent to the hole on the lug. A recessed section is disposed on an outside of each lug, which creates the double-walled reinforcing portion. A concave female portion on each end of the barrier segment, adjacent to said lugs, provides beneficial effects when a barrier formed by multiple barrier segments, joined end-to-end, is impacted by a vehicle, as described more fully herein below.

Preferably, each lengthwise outer wall is formed in a vertically oriented concave curved shape. A concave center portion of each lengthwise outer wall has a curve radius of 24¾ inches.

In preferred embodiments, a length of metallic cable is molded within the molded plastic container, so that most of the length of metallic cable is entirely disposed within the interior volume, along substantially an entire length of said container between the first and second ends.

In yet another aspect of the invention, there is disclosed a method of making a barrier segment for use in creating a roadside barrier system. This method comprises steps of disposing at least one wire rope cable within a mold tool, and using the mold tool to mold a plastic hollow container. When the molding step is completed, the wire rope cable is irremovably disposed within the plastic hollow container. The disposing step preferably comprises disposing a plurality of wire rope cables within the mold tool.

The invention, together with additional features and advantages thereof, may best be understood by reference to the following description taken in conjunction with the accompanying illustrative drawing.

BRIEF DESCRIPTION OF THE DRAWINGS

FIG. 1 is an end elevation view showing a configuration of a water barrier segment constructed in accordance with one embodiment of the present invention;

FIG. 2 is a perspective view of a portion of the barrier segment of FIG. 1;

FIG. 3 is a perspective view of the barrier segment of FIGS. 1 and 2;

FIG. 4 is a front elevation view of the barrier segment of FIG. 3;

FIG. 5 is a left end elevation view of the barrier segment of FIGS. 1-4;

FIG. 6 is a right end elevation view of the barrier segment of FIGS. 1-4

FIG. 12 is a plan view from the top showing two connected barrier segments rotating with respect to one another upon vehicular impact;

FIG. 13 is a cross-sectional plan view taken along lines A-A of FIG. 8, after vehicular impact and relative rotation of the two barrier segments;

FIG. 14 is a cross-sectional plan view of the detail section C of FIG. 13;

FIG. 15 is a elevation view of a barrier segment of the type shown in FIG. 7, showing some of the constructional details of the segment;

FIG. 16 is a top plan view of the barrier segment of FIG. 15;

FIG. 17 is an end elevation view of the barrier segment of FIG. 15;

FIG. 18 is a perspective view showing three barrier segments secured together;

FIG. 19 is a perspective view of a second, presently preferred embodiment of a barrier segment constructed in accordance with the principles of the present invention;

FIG. 20 is a front elevation view of the barrier segment shown in FIG. 19;

FIG. 21 is an end elevation view of the barrier segment shown in FIGS. 19-20;

FIG. 22 is a top plan view of the barrier segment shown in FIGS. 19-21;

FIG. 23 is a perspective view of the barrier segment shown in FIGS. 19-22, taken from an opposing orientation;

FIG. 24 is an end elevation view of the barrier segment of FIG. 23;

FIG. 25 is a sectioned perspective view of the barrier segment of FIG. 23, showing internal constructional features of the barrier segment, and in particular a unique cable reinforcement system;

FIG. 26 is a front sectioned view of the barrier segment of FIG. 25;

FIG. 27 is a sectioned detail view of the portion of FIG. 26 identified as detail A;

DESCRIPTION OF THE PREFERRED EMBODIMENT

Figure 7:
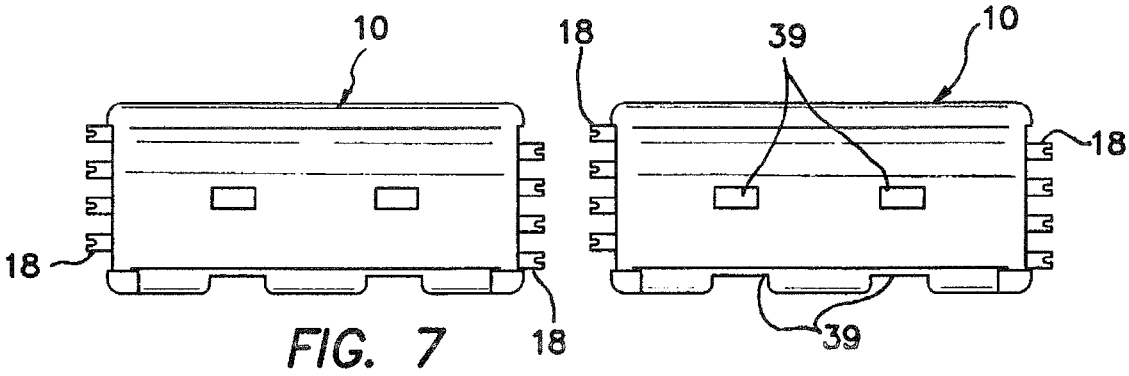
FIG. 7 is a front elevation view showing two barrier segment such as that shown in FIG. 4, wherein the segments are detached.

Referring now more particularly to the drawings, there is shown in FIGS. 1-3 and 15-17 a water-ballasted barrier segment 10 constructed in accordance with one embodiment of the present invention. The illustrated barrier segment preferably has dimensions of 18 in. W×32 in. H×78 in. L, with a material thickness of ¼ in. The material used to fabricate the segment 10 may be a linear medium density polyethylene, and is preferably rotationally molded, although it may also be molded using other methods, such as blow molding. The segment 10 preferably has an empty weight of 75-80 lb., and a filled weight (when filled with water ballast) of approximately 1100 lb. Detailed dimensional details of the disclosed embodiment are illustrated in FIGS. 15-17.

Particularly with respect to FIGS. 1-2, the barrier segment 10 has been constructed using a unique concave redirective design, wherein outer walls 12 of the barrier segment 10 are configured in a concave manner, as shown. In a preferred configuration, the concave section is approximately 71 inches long, and runs the entire length of the barrier segment. The concave section is designed to prevent the tire of a vehicle, impacting the barrier along the direction of arrow 14, from climbing up the side of the barrier segment, by pocketing the tire in the curved center portion of the barrier wall 12. When the vehicle tire is captured and pocketed inside the curved portion, the reaction force of the impact then diverges the vehicle in a downward direction, as shown by arrow 16 in FIG. 1. The concave diverging design will thus assist in forcing the vehicle back toward the ground rather than up the side of the water barrier segment 10. In a preferred configuration, as shown in FIG. 1 the concave center portion of the outer wall 12 has a curve radius of 24¾ in., and is 23 inches in height.

FIGS. 3-11 illustrate an interlocking knuckle design for securing adjacent barrier segments 10 together. The interlocking knuckle design is a lug pin connection system, comprising four lugs 18 disposed in interweaved fashion on each end of the barrier segment 10. Each lug 18 is preferably 8 inches in diameter, and 2 inches thick, although various dimensions would be suitable for the inventive purpose. To achieve the interweaved effect, on a first end 20 of the barrier segment 10, the first lug 18 is disposed 4 inches from the top of the segment 10. The remaining three lugs 18 are equally spaced vertically 3½ inches apart. On a second end 22 of the barrier segment 10, the first lug 18 is disposed 7 inches from the top of the barrier segment 10, with the remaining three lugs 18 being again equally spaced vertically 3½ inches apart. These dimensions are preferred, but again, may be varied within the scope of the present invention.

Figure 8:
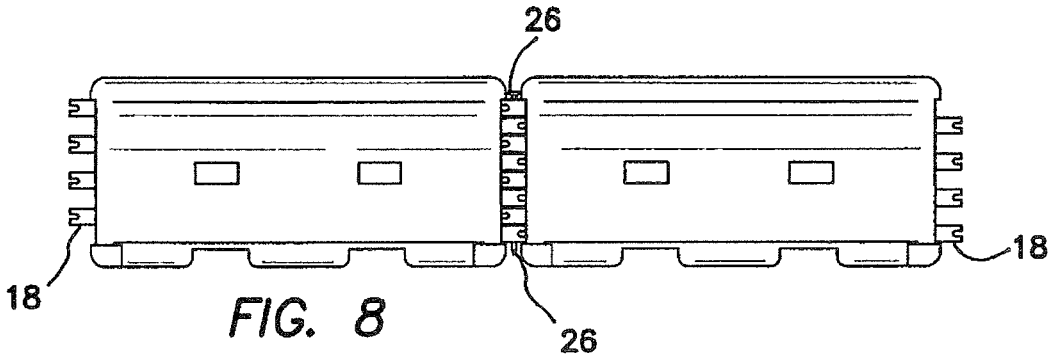
FIG. 8 is a front elevation view similar to FIG. 7, showing the barrier segments after they have been attached to one another.
Figure 10:
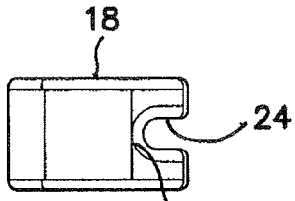
FIG. 10 is a cross-sectional view showing a double wall reinforcement area for a pin lug on the barrier segment.

When the ends of two adjacent barrier segments 10 are placed together, as shown sequentially in FIGS. 7 and 8, the complementary lugs 18 on the mating ends of the adjoined segments 10 slide between one another in interweaved fashion, due to the offset distance of each lug location, as described above, and shown in FIGS. 4 and 7. The lugs' dimensional offset permit each segment 10 to be linked together with one lug atop an adjacent lug. This results in a total of eight lugs on each end of the water barrier segment 10 that lock together, as see in FIG. 8. Each lug 18 has a pin receiving hole 24 disposed therein, as best shown in FIG. 10. When the eight lugs 18 are engaged, as discussed above, upon the adjoining of two adjacent barrier segments 10, these pin receiving holes 24, which are preferably approximately 1½ inches in diameter, and are disposed through the two inch thick portion of the lug 18, correspond to one another. Thus, a T-pin 26 is slid vertically downwardly through the corresponding pin receiving holes 24 of all eight lugs or knuckles 18, as shown in FIG. 8, in order to lock the two adjoined barrier segments 10 together.

Figure 9:
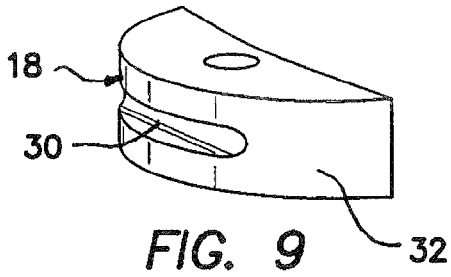
FIG. 9 is a perspective view, in isolation, of an interlocking knuckle for use in attaching two barrier segments together.
Figure 11:
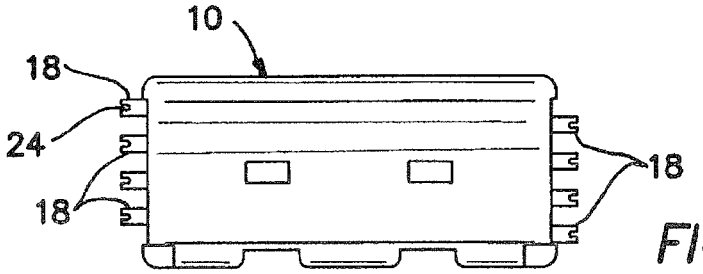
FIG. 11 is a front elevation view similar to FIG. 7 showing a barrier segment.

To reduce the bearing load on the pin lug connection, a double wall reinforcement 28 is included on the backside of the hole 24 on the lug 18, as shown in FIG. 10. The double reinforced wall is created by molding an indentation 30 on an outer curved section 32 of the lug 18, as shown in FIG. 9. The removal of material on the outside curved section 32 of the lug 18 creates a double reinforced wall on the inside section of the lug. The wall created by the recessed section 30 on the outside of the lug creates a reinforcement section 28 against the vertical hole 24 in the lug 18, as shown in sectioned FIG. 10. By creating this double wall reinforcement section 28, the T-pin 26 has two approximately ¼ inch thick surfaces to transfer the load to the T-pin 26 during vehicular impact. This arrangement will distribute the bearing load over a larger area, with thicker material and more strength.

During impact, the water barrier can rotate at the pin lug connection, resulting in large stresses at the pin lug connection during maximum rotation of the water wall upon impact. To reduce the stresses at the pin lug connection, a concave inward stress transfer zone is formed between the male protruding lugs 18, as shown in FIGS. 12-14. The concave inward section creates a concave female portion 34 at the ends of each water wall segment where the male end of each lug 18 will slide inside when aligned, as illustrated. Before vehicular impact, the male lugs 18 are not in contact with any surface inside the concave female portion 34 of the barrier segment 10. However, when the segment 10 is impacted, and is displaced through its full range of rotation (approximately 30 degrees), as shown in the figures, the external curved surface of the male lugs will come into contact with the external surface of the inside wall of the concave female portion, as shown in FIG. 14. This transfers the load from the pin lug connection to the lug contact point of the male/female portion. By transferring the load of the vehicular impact from the pin lug connection to the female/male contact point, the load is distributed into the male/female surface contact point before the pin connection begins to absorb the load. This significantly reduces the load on the T-pin 26, preventing the pin itself from bending and deforming during the impact.

To accommodate the ability to dispose a fence 36 or any other type of device to block the view on ones side of the barrier 10, the t-pins 26 are designed to support a square or round tubular fence post 38, as shown in FIG. 18. The tubular post 38 is adapted to slip over the t-pin, with suitable retaining structure disposed to ensure that the post 38 is firmly retained thereon.

In a preferred method, each barrier segment 10 is placed at a desired location while empty, and relatively light. This placement may be accomplished using a forklift, for example, utilizing forklift apertures 39. Once the segments are in place, and connected as described above, they can then be filled with water, using fill apertures 39*a* as shown in FIG. 3. When it is desired to drain a barrier segment, drain apertures, such as aperture 39*b* in FIG. 15, may be utilized.

Now referring in particular to FIGS. 19-21, a second embodiment of a water-ballasted barrier segment 110 is illustrated, wherein like elements are designated by like reference numerals, preceded by the numeral 1. This barrier segment 110 is preferably constructed to have overall dimensions of 24 in. W×42 in. H×78 in. L, with a material thickness of ¼ inches. As in the prior embodiment, these dimensions are presently preferred, but not required, and may be varied in accordance with ordinary design considerations. The material of which the barrier segment 10 is fabricated is preferably a high density polyethylene, and the preferred manufacturing process is rotational molding, although other known processes, such as blow molding, may be used.

The illustrated embodiment utilizes a unique configuration to ensure that an impacting vehicle will be prevented from driving up and over the segment 10 upon impact. This configuration comprises a saw tooth profile, as illustrated, which is designed into the top portion of the barrier segment 10, as shown in FIGS. 19-24. The design intent of the saw tooth profile is to snag the bumper, wheel, or any portion of a vehicle impacting the barrier 10 from a direction indicated by arrow 114 (FIG. 23) and to deflect the vehicle in a downward direction as indicated by arrow 116 (FIG. 23). The saw tooth profile shape runs the entire length of each section of the barrier segment 10, as shown. A first protruding segment or sawtooth 40, forming the sawtooth profile, begins to protrude approximately 20 inches above the ground, and second and third protruding segments 42, 44, respectively are disposed above the segment 40, as shown. Of course, more or fewer sawtooth segments may be utilized, depending upon particular design considerations. The design intent of using a plurality of sawtooth segments is that, if the first tooth or segment 40 does not succeed in containing the vehicle and re-directing it downwardly to the ground, the second or third teeth 42, 44, respectively, should contain the vehicle before it can successfully climb over the barrier 10.

The first embodiment of the invention, illustrated in FIGS. 1-18, is capable of meeting the earlier described TL-1 crash tests, but plastic construction alone has been found to be insufficient for withstanding the impact of a vehicle traveling 70 kph or 100 kph, respectively, as required under TL-2 and TL-3 testing regimes. The plastic does not have sufficient physical properties alone to stay together, pocket, or re-direct an impacting vehicle at this velocity. In order to absorb the energy of a vehicle traveling at 70 to 100 kph, the inventors have found that steel components need to be incorporated into the water barrier system design. Using steel combined with a large volume of water for ballast and energy absorption enables the properly designed plastic wall to absorb the necessary energy to meet the federal TL-2 and TL-3 test requirements at such an impact.

To contain the 70 to 100 kph impacting vehicle, the inventors have used the interlocking plastic knuckle design described earlier in connection with the TL-1 water barrier system described and shown in FIGS. 1-18 of this application. The same type of design principles are used in connection with this larger and heavier TL-2 and TL-3 water barrier system, which includes the same interlocking knuckle attachment system disclosed in connection with the first embodiment.

The TL-2 and TL-3 barrier system described herein in connection with FIGS. 19-31 absorbs energy by plastic deformation, water displacement, wire rope cable fencing tensioning, water dissipation, and overall displacement of the water barrier itself. Since it is known that plastic alone cannot withstand the stringent test requirements of the 70-100 kph TL-2 and TL-3 vehicular impact protocols, internally molded into the barrier segment 110 is a wire rope cable 46, which is used to create a submerged fence inside the water barrier segment 110 as shown in FIGS. 25 and 26. Before the barrier segment 110 is molded, the wire rope cables 46 25 are placed inside the mold tool. The cables are made with an eyelet or loop 48 (FIG. 30) at each end, and are placed in the mold so that the cable loops 48 wrap around the t-pin hole 124 outside diameter as shown in FIG. 27. Preferably, the wire rope cables 46 are each comprised of stainless steel, or galvanized and stranded steel wire cable to resist corrosion due to their contact with the water ballast, and are formed of ⅜ inch 7×19 strands. By placing the cables 46 around the t-pin holes 124, dual fence posts are created on each side of the barrier segment 110, with four cable lines 46 disposed in between, thereby forming an impenetrable cable fence in addition to the water ballast. It is noted that the wire cable loops ends are completely covered in plastic during the rotational molding process, to prevent water leakage.

Figure 28:
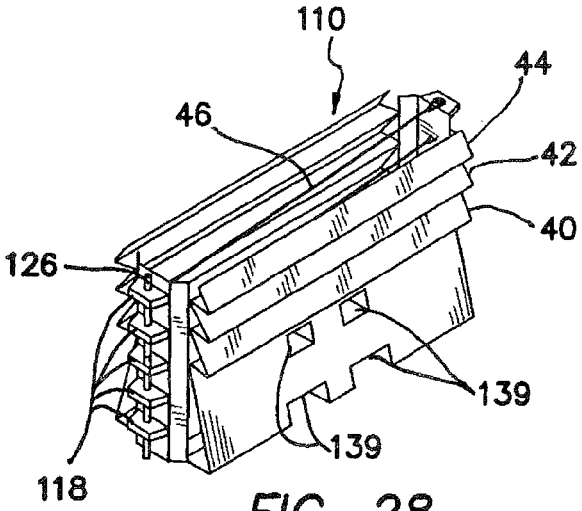
FIG. 28 is a perspective view of the barrier segment of FIGS. 19-27.
Figure 30:
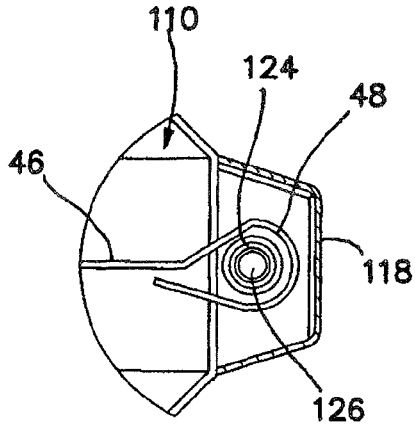
FIG. 30 is a sectioned detail view of the portion of FIG. 29 identified as detail A.
Figure 29:
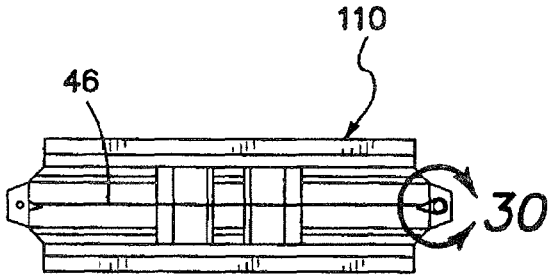
FIG. 29 is a top plan view of the barrier segment of FIG. 28.

By placing the wire rope cable 46 and wrapping it around the t-pin hole 124, a high strength area in the interlocking knuckles is created. When the t-pin 126 is dropped into the hole 124, to connect a series of barrier fence segments 110, it automatically becomes a steel post by default, since the wire rope cable segments 46 are already molded into the barrier segments. Since the loop of each cable end wraps around the t-pin in each knuckle, the impacting vehicle will have to break the wire rope cable 46, t-pin 126, and knuckle in order to penetrate the barrier. FIGS. 28-30 illustrate how the wire rope cables 46 wrap the T-pin holes 124.

Figure 31:
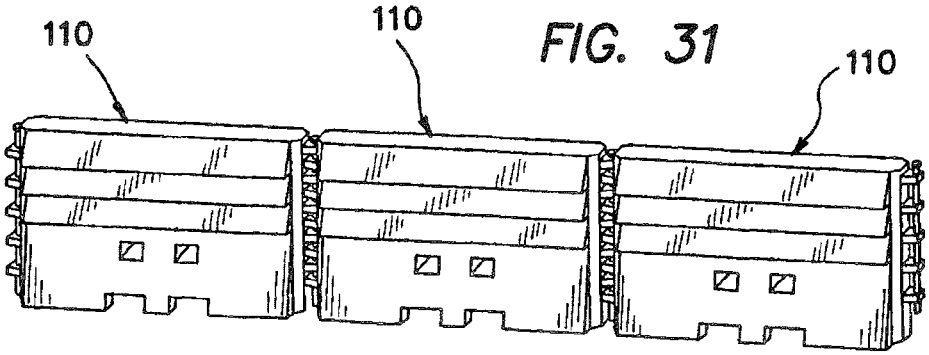
FIG. 31 is a perspective view showing three barrier segments secured together.

The wire rope cables 46 are an integral part of each barrier segment 110, and cannot be inadvertently omitted or removed once the part has been manufactured. The current design uses up to five wire rope cables 46 per barrier segment 110, as illustrated. This creates a ten piece interlocking knuckle section. More or fewer knuckles and wire rope cables may be utilized, depending upon whether a lower or taller barrier is desired. The wire rope fence construction disclosed in connection with this second TL-2 or TL-3 embodiment can also be incorporated into the lower height barrier illustrated and described in FIGS. 1-17. When large numbers of barrier segments are used to create a longitudinal barrier, a wire rope cable fence is formed, with a t-pin post, with the whole assembly being ballasted by water without seeing the cable fencing. FIG. 31 illustrates such a plurality of segments 110, interlocked together to form a barrier as just described. As illustrated, each barrier segment is approximately 2100 lb when filled with water.

As the barrier illustrated in FIG. 31 is impacted by a vehicle, the plastic begins to deform and break, water ballast is displaced, and water is dispersed while the wire rope cables 46 continue the work of absorbing the impact_energy by pulling along the knuckles and pulling the series of wire rope cables in tension. The entire area of impact immediately becomes a wire rope cable fence in tension, holding the impacting vehicle on one side of the water ballasted barrier.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A barrier segment which is hollow and adapted to be filled with a fluent material for ballast, comprising:

a molded plastic container having outer walls defining an interior volume and having a first end and a second end;

a plurality of plastic connecting lugs disposed on each of said first and second ends, so that a plurality of barrier segments may be joined together; and a length of metallic cable molded into said molded plastic container, so that most of the length of metallic cable is entirely disposed within said interior volume, along substantially an entire length of said container between said first and second ends;

a hole in each of said connecting lugs, for receiving a connecting pin;

a loop disposed at each end of the length of cable, wherein each said loop surrounds the hole disposed in one of said lugs, the loop being molded to the plastic comprising the lug about which the loop is disposed, such that the loop is fixedly attached to the lug; and a fence post adapted for disposition over a top end of a connecting pin, for supporting a fence above the barrier segment.

2. A barrier segment which is hollow and adapted to be filled with a fluent material for ballast, comprising:

a molded plastic container having outer walls defining an interior volume and having a first end and a second end;

a plurality of plastic connecting lugs disposed on each of said first and second ends, so that a plurality of barrier segments may be joined together;

a length of metallic cable molded into said molded plastic container, so that most of the length of metallic cable is entirely disposed within said interior volume, along substantially an entire length of said container between said first and second ends;

a hole in each of said connecting lugs, for receiving a connecting pin; and a loop disposed at each end of the length of cable, wherein each said loop surrounds the hole disposed in one of said lugs, the loop being molded to the plastic comprising the lug about which the loop is disposed, such that the loop is fixedly attached to the lug;

said outer walls having a plurality of sawtooth segments disposed thereon, which are arranged vertically and extend outwardly and downwardly in order to deflect vehicles impacting the barrier segment in a downward direction.

3. The barrier segment as recited in claim 2, wherein there are three sawtooth segments disposed on each lengthwise outer wall.

4. A barrier segment which is hollow and adapted to be filled with a fluent material for ballast, comprising:

a molded plastic container having outer walls defining an interior volume and having a first end and a second end;

a plurality of plastic connecting lugs disposed on each of said first and second ends, so that a plurality of barrier segments may be joined together;

a length of metallic cable molded into said molded plastic container, so that most of the length of metallic cable is entirely disposed within said interior volume, along substantially an entire length of said container between said first and second ends;

a hole in each of said connecting lugs, for receiving a connecting pin; and a loop disposed at each end of the length of cable, wherein each said loop surrounds the hole disposed in one of said lugs, the loop being molded to the plastic comprising the lug about which the loop is disposed, such that the loop is fixedly attached to the lug.

5. The barrier segment as recited in claim 4, wherein each of said connecting lugs comprises a hole for receiving a connecting pin therethrough, and a double-walled reinforcing portion adjacent to the hole on the lug.

6. The barrier segment as recited in claim 5, and further comprising a recessed section on an outside of each lug, which creates said double-walled reinforcing portion.

7. The barrier segment as recited in claim 5, and further comprising a concave female portion on each end of the barrier segment, adjacent to said lugs.

8. The barrier segment as recited in claim 5, wherein each lengthwise outer wall is formed in a vertically oriented concave curved shape.

9. The barrier segment as recited in claim 8, wherein a concave center portion of each lengthwise outer wall has a curve radius of 24¾ inches.

10. A method of making a barrier segment for use in creating a roadside barrier system, the method comprising:

disposing at least one wire rope cable having a loop attached to each opposing end thereof within a mold tool; and using the mold tool to mold a plastic hollow container having outer walls defining an interior volume and having a first end and a second end, said container further having a plurality of connecting lugs disposed on each of said first and second ends;

molding a hole in each of said connecting lugs, for receiving a connecting pin; and molding each of said loops into a corresponding one of said connecting lugs, so that the loop surrounds the hole disposed in the lug and is in fixed relation therewith;

such that, when the molding step is completed, the wire rope cable is irremovably disposed within said plastic hollow container.

11. The method as recited in claim 10, wherein the disposing step comprises disposing a plurality of wire rope cables within said mold tool.

* * * * *